US005605018A

United States Patent [19]

McElderry et al.

[11] Patent Number: 5,605,018

[45] Date of Patent: Feb. 25, 1997

[54] FLEXIBLE ROOF END CAP

[75] Inventors: James W. McElderry, Schaumburg; Michael C. Dill, Elk Grove Village; Juergen O. Rathgeber, Arlington Heights; John A. Wand, Crystal Lake, all of Ill.; John F. Fox, Riverdale, Ga.

[73] Assignee: Illinois Tool Work Inc., Glenview, Ill.

[21] Appl. No.: 511,520

[22] Filed: Aug. 4, 1995

[51] Int. Cl.[6] ..... E04B 7/00

[52] U.S. Cl. ..... 52/57; 52/54; 52/90.1

[58] Field of Search ..... 52/1–44, 53, 54, 52/57, 90.1, 94, 96, 463, 465, 47, 58

[56] References Cited

U.S. PATENT DOCUMENTS

| | | | |
|---|---|---|---|
| 1,149,572 | 8/1915 | Gall | 52/55 |
| 1,273,399 | 7/1918 | O'Connor . | |
| 1,968,451 | 1/1934 | Hering | 108/10 |
| 2,664,177 | 12/1953 | Hammitt et al. | 52/58 |
| 4,045,928 | 9/1977 | Malott | 52/199 |
| 4,420,913 | 12/1983 | Long et al. | 52/57 |
| 4,543,758 | 10/1985 | Lane | 52/410 |
| 5,392,583 | 2/1995 | Gregory | 52/741.1 |

*Primary Examiner*—Carl D. Friedman
*Assistant Examiner*—Beth Aubrey
*Attorney, Agent, or Firm*—Mark W. Croll; Thomas W. Buckman; John P. O'Brien

[57] ABSTRACT

A flexible end cap includes at least one flexible membrane, such as a rubber sheet, for covering the end of the roof rib, having a top peripheral portion and a bottom peripheral portion. At least one frame member is attached to at least a portion of the top peripheral portion of the flexible membrane for supporting the membrane in a sealing relationship with the roof rib. At least a portion of the bottom peripheral portion, such as the portion for covering a ridge profile, includes at least two sealing ribs wherein a cross-sectional height of one rib is larger than a cross-sectional height of the other rib. The sealing ribs with the larger cross-sectional height allow the end cap to accommodate varying designs of roof rib profiles formed by adjacent sheets of roof panels.

17 Claims, 3 Drawing Sheets

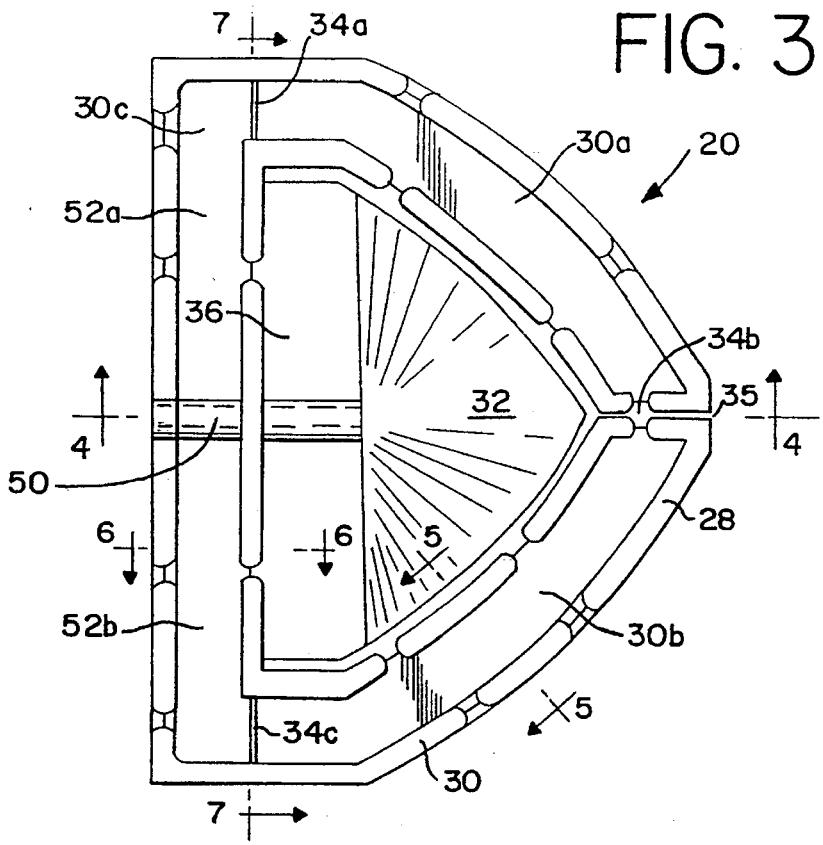
FIG. 3
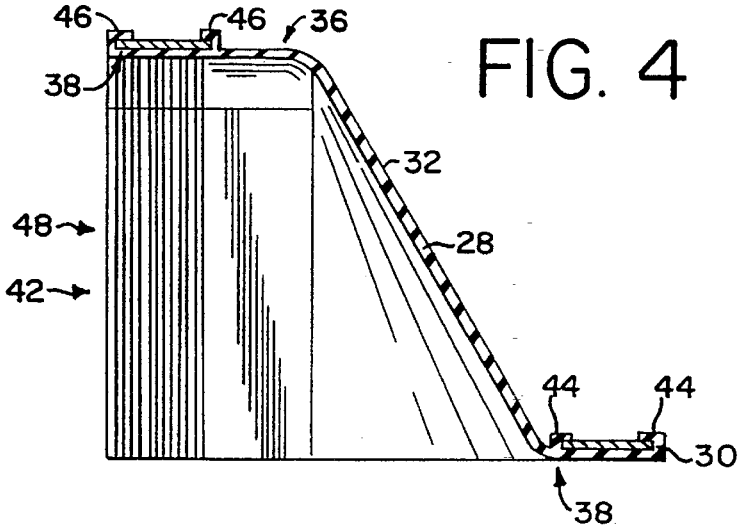
FIG. 4
FIG. 5
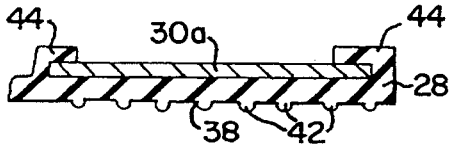
FIG.6
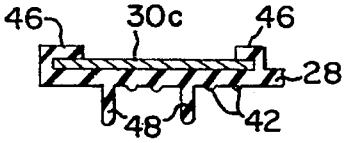

FLEXIBLE ROOF END CAP

BACKGROUND OF THE INVENTION

The present invention relates generally to devices for use with roofs made from sheet metal panels and more particularly, to roof end caps that cover an end of a roof rib formed by two interconnected sheet metal panels.

Sheet metal roofs are typically formed by interconnecting the edges of panels of sheet metal. Generally, one edge of a panel has a male configuration and an adjacent panel has a female configuration so that the edges of adjacent panels can be connected to each other. The connection forms a roof rib defining a seam. The roof rib is typically hollow and has a raised ridge (seam) to allow ease in connecting the sheets together and to allow water to run away from the seam. Since the roof rib has an open end near the apex or ridge of the roof, an end cap is needed to seal the end of the roof rib. End caps are also needed at an upper end of a rib and a lower end wherever roof penetrations, such as air conditioner ducts or chimneys, extend through the roof.

Conventional end caps typically overlay a portion of the end of the roof rib formed by the connection of the two panels cover the end portion of the rib. End caps are usually attached to the roof via rivets or self-tapping screws and some type of sealant or glue. The end caps so affixed form a water-tight seal. Some installations include the use of tape mastic or caulk between the bottom surface of the end cap and the top surface of the roof so that the mastic is compressed between the end cap and the roof. Known end caps are integrally formed from rigid metal or rigid plastic and are only designed to attach to a specific manufacturer's sheet panels.

It is typical that each manufacturer of sheet metal panels has its own unique male and female configuration and edge profile so that separate end caps for each type of roof rib profile must be purchased and stored by building manufacturers and roof installers to accommodate the various different designs. As a further complication, some rigid plastic end caps are designed to only be used with specific left-handed or right-handed rib profiles. Generally, existing end caps are not readily interchangeable such that one end cap can be used for more than one type of roof rib profile.

Some known end caps have a bottom peripheral portion that typically includes small parallel sealing grooves running the entire length of the bottom peripheral surface and all of the sealing grooves are of the same cross-sectional depth. The sealing grooves generally provide increased surface area for the sealant or glue and help contain the sealant under the end cap.

A mismatch of end cap type and rib profile may result in an ineffective seal due to the differences in surface contour. The sealant grooves may be too short to effectively seal gaps between the contour surfaces defining the roof rib profile. This can be exacerbated by contraction and expansion of panel joints during changing climate conditions.

Consequently, there is a need for a type of end cap which enables a reduction of the number and types of end caps inventoried by distributors and sellers. Such an end cap would provide a significant cost reduction. There is also a need for an end cap which can be used for a number of different types of manufacturer's roof rib profile designs and still provide adequate sealing.

Thus, a main object of the present invention is to provide a universal end cap which may be compatible with a number of different types of roof rib profiles.

Another object of the present invention is to provide a flexible end cap that provides improved sealing capabilities along the roof rib profile of varying roof rib profile designs.

It is another object of the present invention to provide a flexible end cap that may better accommodate changes in expansion and contraction due to climatic changes to improve the life and reliability of the roof.

SUMMARY OF THE INVENTION

Accordingly, the above-listed objects are met or exceeded by the present flexible roof end cap device having a flexible membrane and associated frame members that can be affixed to a plurality of different sheet metal roof rib profile designs. The disclosed flexible end cap includes at least one flexible membrane, such as a rubber sheet, for covering the end of the roof rib, having a top peripheral portion and a bottom peripheral portion. At least one frame member is attached to at least a portion of the top peripheral portion of the flexible membrane for supporting the membrane in a sealing relationship with the roof rib.

At least a portion of the bottom peripheral portion, such as the portion for covering the roof rib profile, includes at least two sealing ribs, wherein a cross-sectional height of one rib is larger than a cross-sectional height of the other rib. The sealing ribs with the larger cross-sectional height allow the end cap to accommodate varying designs of roof rib profiles formed by adjacent sheets of roof panels.

The frame members may be integrally molded strips of aluminum separated by gaps to provide greater flexibility during installation. The flexible membrane is generally UV and temperature resistant, and relatively impervious to moisture. The frame member that covers the roof rib profile is bendable to allow the flexible end cap to cover and seal an end of a roof rib formed by various sizes and contours of sheet metal roof panels. A tip section that covers the roof rib seam includes sealing ribs to retain caulk about the seam.

BRIEF DESCRIPTION OF THE DRAWINGS

FIG. 3 is a top plan view of an embodiment of a flexible end cap in accordance with the invention;

FIG. 4 is a cross-sectional view taken along the line 4—4 of FIG. 3 and in the direction generally indicated;

FIG. 5 is a sectional view taken along the line 5—5 of FIG. 3 and in the direction generally indicated;

FIG. 6 is a sectional view taken along line 6—6 of FIG. 4 and in the direction generally indicated;

DESCRIPTION OF THE PREFERRED EMBODIMENT

Figure 1:
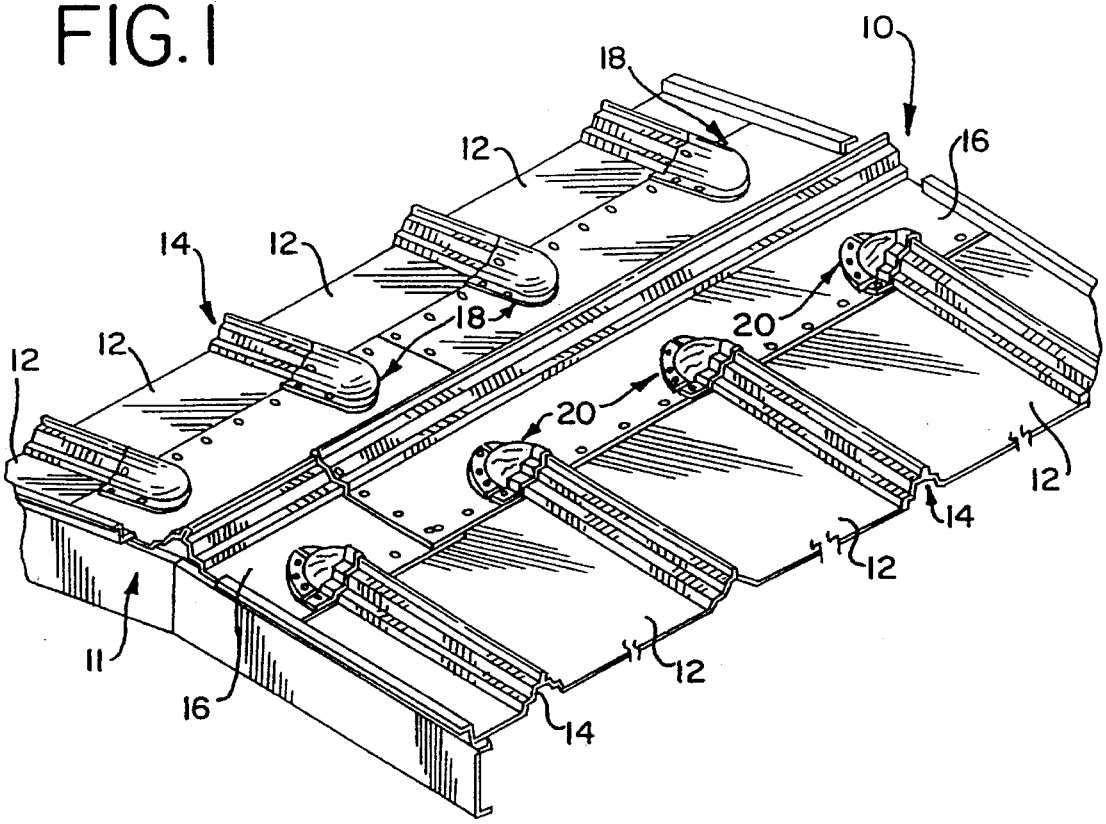
FIG. 1 is a partial perspective view of a portion of a sheet metal roof having a prior art end cap design and also showing an embodiment of the present end cap design.

Referring now to FIG. 1, a roof 10 is shown having a roof ridge 11 wherein the roof is covered by a number of interconnected sheet metal panels 12. Each panel 12 is provided with a so-called male and female edge. A roof rib 14 is formed by corresponding male and female edges of adjacent sheet metal panels 12 to form a ridge. Each roof rib 14 has a unique profile depending upon the manufacturer. The male and female edges are crimped together using techniques well known to skilled practitioners. Sheet metal ridge panels 16 are overlayed on top of the sheet metal panels 12 to form the ridge 11 or peak of the roof 10.

Also shown are general depictions of prior art rigid roof end caps 18 which cover the end of each the roof ribs 14. The end caps 18 are attached to the ridge panel 16 via glue and fasteners such as screws or rivets. A caulk or sealant is typically applied to the bottom of the end cap prior to the end cap being secured to the ridge panel 16.

The rigid end caps 18 cover the ends of the roof rib 14 to prevent water from entering under the roof rib. Typically, end caps 18 are one integral piece made of metal or plastic, and generally suffer from the problems earlier mentioned. Also shown are the present flexible end caps generally designated 20.

Figure 2:
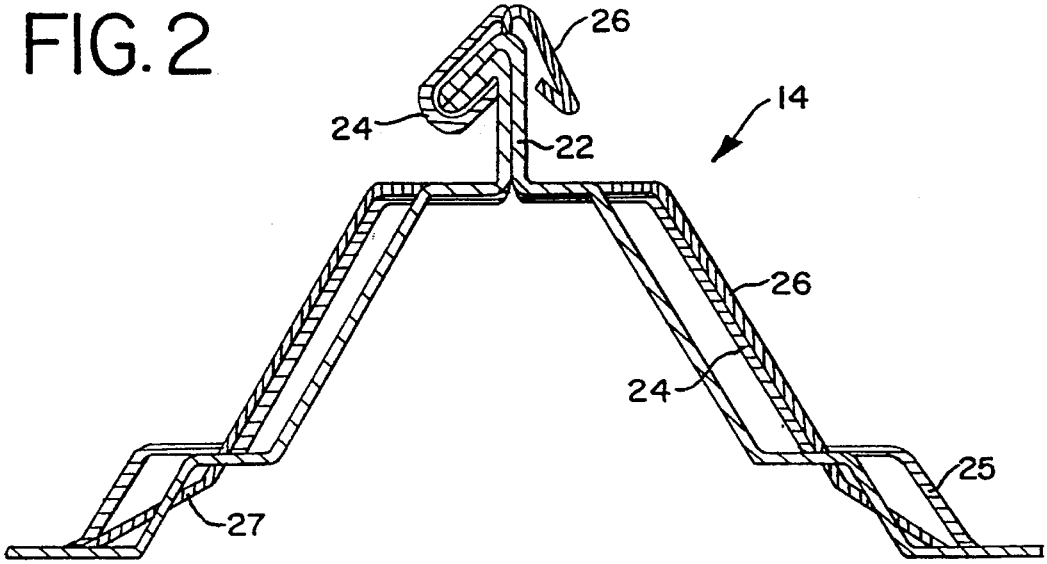
FIG. 2 is a cross-sectional view generally depicting some different types of conventional roof rib configurations and profiles formed by sheet metal panel edges.

Referring now to FIG. 2, three different types of sheet metal roof ribs are generally depicted to illustrate the variability among manufacturers' designs. For example, roof rib profile 22 is relatively narrow in profile, and the edges are crimped to the left. Roof rib profile 24 (male edge shown) is slightly wider than the profile 22 and has a broader base portion 25. While profile 24 is also crimped to the left, it includes a distinctive crimp compared to the profile 22. Lastly, roof rib profile 26 (female edge shown) is slightly taller and wider than 24, with a narrower base 27. Also the profile 26 has a right-handed crimp. As illustrated, the width and orientation of the roof rib seam and roof rib profile varies depending upon the type of roof rib formed and demonstrates how a variety of end cap configurations is needed to properly seal each of these profiles.

Referring now to FIG. 3, one embodiment of the end cap 20 is shown. The flexible end cap 20 includes a flexible membrane 28 such as a rubber sheet and preferably includes bendable metal panel frame members 30*a*, 30*b*, and a bendable metal ridge frame member 30*c* which are preferably molded into flexible membrane 28. The frame members 30*a*–30*c* support the membrane in a sealing relationship with the roof rib 14. Although three separate pieces are used as 11 as frame members, it will be recognized that one frame member or two frame members may be suitable for some applications.

The flexible membrane 28 is preferably made from a combination of Ethylene Propylene Diene (EPDM) and polypropylene, such as that sold under the tradename SARLINK, manufactured by D.S.M., or SANTOPRENE, manufactured by Advanced Elastomers, Inc. Other suitable thermoplastic elastomers and polymeric materials are contemplated which are relatively impervious to moisture, and resistant to stress caused by changes in climate such as temperature and humidity. Such climatic changes can cause expansion and contraction of roof panels and roof ribs, thereby causing stress on the end caps. The rubber-like like or pliant features of the flexible membrane 28 allow the membrane to be stretched or flexed about varying sized ends of roof ribs to provide a universal end cap that accommodates varying configurations of roof rib profiles and sizes.

The flexible membrane 28 has a flange or panel portion 30 which attaches to a top surface of a roof panel, and a ridge portion 32 which primarily covers the ridge and profile of a roof rib 14. As shown, the panel portion 30 may include at least two separate panel frame members 30*a* and 30*b* preferably made of a bendable strip of metal such as aluminum or other material which can be formed and retain its bent shape. The bendability allows the panel portion to conform to contours of the roof rib 14. Preferably, the outer periphery of the panel portion is defined by flanges that accommodate the width of each of the pane portion frame members 30*a* and 30*b*.

Each of the panel portion frame members 30*a*–30*b* and the ridge frame member 30*c* are preferably spaced apart from one another along the periphery of the flexible membrane 28 by gaps 34*b*–34*c*. These gaps 34*a*–34*c* allow some movement of the flexible membrane once it is attached to the roof, and also facilitate installation by a user, since the flange portion and ridge portion may be manipulated about a vertical axis to better conform to the roof rib 14. As shown, the gap between the frame members 30*a* and 30*b* may include a portion of flexible rubber membrane material and a cut out area 35 extending through a top and bottom peripheral portion of the flexible member to enhance flexibility. As an alternative, the separate frame members 30*a* and 30*b* may be a single strip with a notch or notches to perform the same function as the gap 34*b*.

The ridge frame member 30c is preferably another bendable aluminum strip or other suitable metal to accommodate varying surface contours of roof ribs. As with the panel portion frame members 30*a* and 30*b*, the ridge portion frame member 30*c* is molded into the flexible membrane 28 on a top peripheral edge of the ridge portion 32. The frame members 30*a*–30*c* are insert molded as part of the flexible membrane, using well known molding processes. However, it will be recognized that non-integral separate frame members are contemplated depending on the application. It will also be recognized that additional separate frame members may be employed if additional flexibility is sought.

Another contemplated alternative embodiment involves the substitution of metal frame members 30*a* and 30*b*, with a thicker, more rigid cross-section of membrane material, or material having a higher durometer in the peripheral portions.

The flexible membrane 28 also includes a relatively flat transitional portion 36 which is located adjacent to the ridge portion frame member 30*c*. The transitional portion 36 is formed from the flexible membrane material, and provides additional versatility by allowing the end cap 20 to cover varying amounts of area along the end of the roof rib 14. Such a transitional portion 36 may not be necessary where the end area covered by the ridge frame member 30*c* is suitable to provide adequate cover over the end of the roof rib 14.

Referring now to FIGS. 4 and 5, the flexible membrane 28 also has a bottom peripheral portion or border generally depicted at 38 which includes a plurality of parallel sealing ribs 42 for containing sealant, glue or other adhesive material which is placed between the end cap 20 and the roof surface to which it is attached.

FIG. 5 generally depicts both top and bottom portions of the panel portion 30. The bottom peripheral portion includes the surface sealing ribs 42, which preferably have the same cross-sectional height. The panel frame members 30*a* and 30*b* are molded into the top peripheral portion of the membrane and are held in place at each edge by a corresponding lip 44 formed from the flexible material. The lip 44 contacts a top surface of the frame member. The lips 44 preferably lie along outer edges of the frame members.

FIG. 6 depicts a cross-section of the ridge portion of a flexible end cap 20. Similar to the lip 44 for securing a frame members 30*a* and 30*b*, lips 46 hold the ridge frame member 30*c* in place. In addition to the surface sealing ribs 42 of the cross-sectional height shown in FIG. 5, the bottom portion of the frame of the ridge section includes additional ridge sealing ribs 48 which have a higher cross-sectional height than the sealing ribs 42. In the preferred embodiment, ridge sealing ribs 48 are substantially parallel to each other but may be non-parallel if desired. As will be seen below, the ridge sealing ribs 48 more readily seal irregularities in the roof rib configuration and also facilitate the retention of caulk or sealant applied between the roof 10 and the end cap 20.

Figure 7:
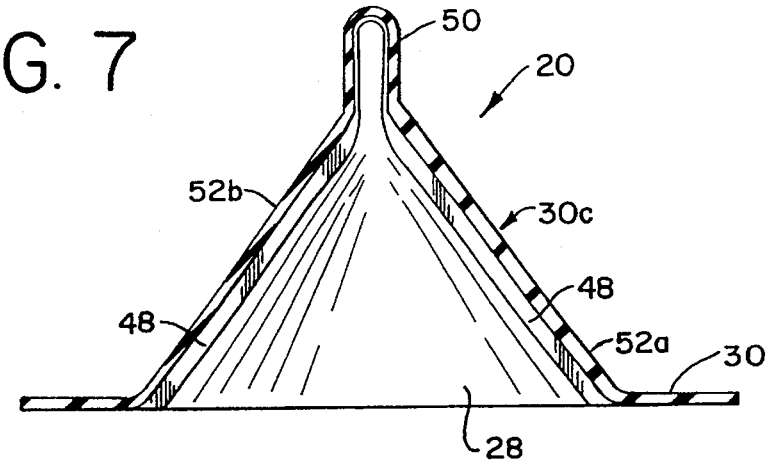
FIG. 7 is a cross-sectional view taken along line 7—7 of FIG. 4 illustrating higher ridge ribs for accommodating differing roof rib profiles in accordance with the invention.

Turning now to FIG. 7, a cross-sectional view of the flexible end cap 20, prior to being formed about a roof rib profile, shows the ridge sealing rib 48 extending from the panel portion 30 to a curved tip portion 50 of the ridge frame member 30*c*. The curved tip portion 50 is generally formed in an inverted "U" shape and has a width large enough to receive various sized crimped male/female edges that form the seam. The interior surface of the curved tip portion 50 has small sealing ribs 42 for enhanced sealing and retention of caulk in this area. The curved tip portion 50 is interposed between two leg sections 52*a* and 52*b*. Preferably, the larger ridge sealing rib 48 does not extend into the curved tip portion 50, but only tapers into the tip portion 50 and extends along the legs 52*a* and 52*b* of the ridge sealing rib 48. Each leg 52*a* and 52*b* has a flanged end distal the tip portion 50 for contact with the roof 10, and each leg is generally flat prior to installation. However, if desired, the legs can also have preformed bends to accommodate general contours of roof rib profiles.

Figure 8:
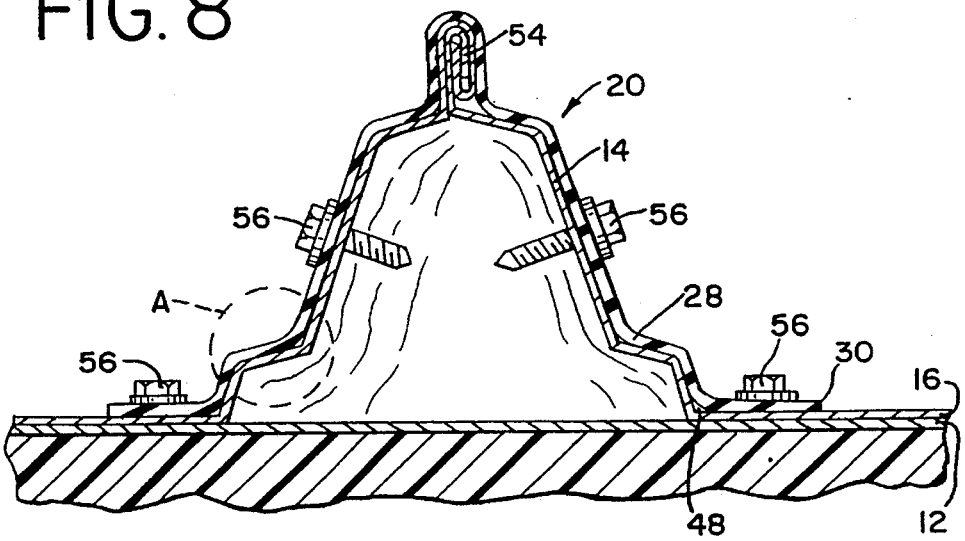
FIG. 8 is a cross-sectional view of a flexible end cap positioned over a roof rib formed by two sheet metal pane) in accordance with an embodiment of the invention.

Referring now to FIG. 8, an installed flexible end cap 20 is shown having the ridge frame member 30*c* bent to conform to the profile of the roof rib 14. To use a flexible end cap 20, an installer may first generally form the flexible end cap by inserting the tip portion 50 over the connected male/female edges 54, the legs 52*a* and 52*b* over the roof rib profile and the panel portion 30 upon the roof panel so that the open end of the roof rib 14 is covered. The legs 52*a* and 52*b* and tip portion 50 of the ridge portion 32 may be bent, by C-shaped vice grips or other suitable device, to tightly conform with the profile of the roof rib 14.

The flexible end cap 20 may then be removed and the installer may apply sealant and/or glue to the sealing ribs 42 and ridge sealing ribs 48 along the bottom peripheral portion of the end cap 20. The installer may then re-apply the flexible end cap 20 near the end of the roof rib 14 and stretch the flexible membrane to an appropriate position on the roof. Next, the installer may attach the end cap 20 to the roof rib 14 using fasteners such as self-tapping metal screws 56, rivets, clamping structures, latching devices or other suitable attachment devices. For example, the self-tapping screws 56 may be driven through the panel portion frame members 30*a*, 30*b* and ridge portion frame member 30*c*. Alternatively, the flexible end cap 20 may have preformed holes through the periphery of the panel section and ridge section to accommodate other types of attachment mechanisms such as rivets.

Figure 9:
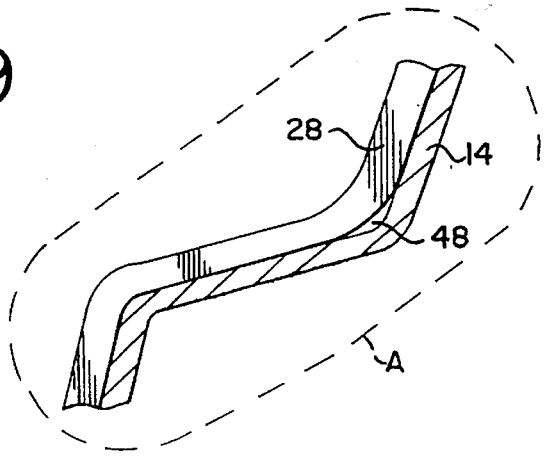
FIG. 9 is a partial cross-sectional view of a section A of FIG. 8 generally depicting the ridge sealing rib in operation.

As shown in FIG. 9, the ridge sealing ribs 48 have a cross-sectional height large enough to fill gaps along creases in the profile. Therefore, many different types of roof rib profiles can be accommodated with a single flexible end cap 20 design.

As disclosed, the bendable ridge frame member 30*c* and flexible membrane 28 with the panel frame members 30*a* and 30*b* allows an installer to conform the ridge section to a majority of known roof ridge shapes, thereby facilitating proper sealing and covering of the end of practically any roof rib size or profile. The multi-sized rib surface configuration of the inventive flexible end cap allows for the end cap to form proper seals along varying profile creases unlike typical rigid end caps.

While a preferred embodiment and several alternative variations of the flexible roof end cap have been shown and described, it will be appreciated by those skilled in the art that changes and modifications may be made thereto without departing from the invention in its broader aspects and as set forth in the following claims.

What is claimed is:

1. A roof end cap for covering an end of a roof rib of a metal roof, comprising:

at least one flexible membrane for covering the end of the roof rib, said membrane being pliant and having a top peripheral portion and a bottom peripheral portion; and at least one frame member for attachment to at least a portion of said top peripheral portion for supporting said flexible membrane in a sealing relationship with the roof rib; and said flexible membrane and said at least one frame member being sufficiently pliant to be manipulable by an installer to cover and seal the end of a roof rib formed by various sizes and contours of metal roof panels.

2. The end cap as defined in claim 1 wherein at least a portion of said bottom peripheral portion includes at least two sealing ribs wherein a cross-sectional height of one rib is larger than a cross-sectional height of the other rib.

3. The end cap as defined in claim 1 wherein said flexible membrane is comprised of a thermoplastic elastomer.

4. The end cap as defined in claim 3 wherein the thermoplastic elastomer is comprised of a combination of Ethylene Propylene Diene and polypropylene.

5. The end cap as defined in claim 1 wherein said at least one frame member is molded into said top peripheral portion of said flexible membrane.

6. The end cap as defined in claim 5 wherein said at least one frame member includes a metal strip.

7. The end cap as defined in claim 1 wherein a portion of said flexible membrane includes a ridge portion having one of said frame members coupled thereto for covering a profile of the roof rib.

8. A roof end cap for covering an end of a roof rib of a metal roof, comprising:

at least one flexible membrane, for covering the end of the roof rib, said membrane being pliant and having a panel portion and a ridge portion, each portion having a top peripheral portion and a bottom peripheral portion, each of said bottom peripheral portions having a plurality of surface sealing ribs thereon;

a panel frame member for attachment to at least a portion of said top peripheral portion of said roof panel section;

a ridge frame member for attachment to at least a portion of said top peripheral portion of said ridge portion, said ridge frame member being bendable to conform to a profile of the roof rib, and said bottom peripheral portion of said ridge portion having a ridge sealing rib thereon in addition to said surface sealing ribs; and said flexible membrane and said frame members being sufficiently pliant to be manipulable by an installer to cover and seal the end of a roof rib formed by various sizes and contours of metal roof panels.

9. The end cap as defined in claim 8 wherein said ridge frame member includes a tip section interposed between two legs and wherein said ridge sealing rib does not extend an entire length of said ridge frame member.

10. A roof end cap for covering an end of a roof rib of a metal roof, comprising:

at least one flexible rubber membrane, formable by an installer to cover the end of the roof rib, said membrane being pliant and having a top peripheral portion and a bottom peripheral portion, said top peripheral portion having at least a first, second, and third frame member molded therein with a gap between adjacent ends of said frame members, said bottom peripheral portion having a ribbed surface, and said third frame member being formable to a general shape of a profile of the roof rib; and said flexible membrane and said at least one frame member being sufficiently pliant to be manipulable by an installer to cover and seal the end of a roof rib formed by various sizes and contours of metal roof panels.

11. The end cap as defined in claim 10 wherein an edge portion of the rubber membrane overlaps an outer edge of each of the frame members and contacts at least a portion of a top surface of the members.

12. The end cap as defined in claim 10 wherein the third frame member is comprised of aluminum.

13. The end cap as defined in claim 12 wherein said third frame member includes a tip section interposed between two legs and further including a ridge sealing rib that does not extend an entire length of said third frame member.

14. The end cap as defined in claim 10 wherein said ribbed surface includes a multi-height ribbed section for contacting an exterior surface of the roof seam.

15. The end cap as defined in claim 10 wherein the gap between said first and second frame members includes a portion of flexible rubber membrane material and a cut out area extending through the top and bottom peripheral portions to enhance flexibility of the first and second frame members.

16. The end cap as defined in claim 13 wherein said tip section is curved and includes sealing ribs on an inner surface thereof.

17. A roof end cap for covering an end of a roof rib comprising:

at least one flexible, pliant membrane, formable to cover the end of the roof rib, having a top peripheral portion and a bottom peripheral portion, said peripheral portions having at least a first, second, and third frame member molded therein with a gap between adjacent ends of said frame members, said bottom peripheral portion having a ribbed surface, said third frame member being formable to a general shape of a profile of the roof rib, and an edge portion of said membrane being configured to overlap an outer edge of each of the frame members and to contact at least a portion of a top surface of the members.

* * * * *